US007726330B2

(12) United States Patent
Schuster

(10) Patent No.: US 7,726,330 B2
(45) Date of Patent: Jun. 1, 2010

(54) AIR CORE FILLING SYSTEM

(76) Inventor: Kurt Schuster, Roemerstrasse 101, A-4800 Attnang-Puchheim (AT)

( * ) Notice: Subject to any disclaimer, the term of this patent is extended or adjusted under 35 U.S.C. 154(b) by 454 days.

(21) Appl. No.: 11/667,674

(22) PCT Filed: Oct. 6, 2005

(86) PCT No.: PCT/AT2005/000395

§ 371 (c)(1),
(2), (4) Date: May 14, 2007

(87) PCT Pub. No.: WO2006/053351

PCT Pub. Date: May 26, 2006

(65) Prior Publication Data

US 2008/0011356 A1 Jan. 17, 2008

(30) Foreign Application Priority Data

Nov. 16, 2004 (EP) ..... 04450210

(51) Int. Cl.
*F16K 15/20* (2006.01)

(52) U.S. Cl. ..... 137/225; 137/224; 5/713; 417/473

(58) Field of Classification Search ..... 137/224, 137/224.5, 225; 5/713; 417/473; 297/DIG. 8
See application file for complete search history.

(56) References Cited

U.S. PATENT DOCUMENTS 883,228 A * 3/1908 Pasteur ..... 137/225
1,151,044 A * 8/1915 Relyea ..... 137/225
1,715,735 A * 6/1929 Banning, Jr. ..... 417/473
1,805,397 A * 5/1931 Harris ..... 137/224.5
1,857,917 A * 5/1932 Koehler, Jr. et al. ..... 137/224.5

(Continued)

FOREIGN PATENT DOCUMENTS

EP 0620716 3/1998

(Continued)

OTHER PUBLICATIONS

English Abstract of EP 0620716.

*Primary Examiner*—John Rivell
*Assistant Examiner*—Craig Price
(74) *Attorney, Agent, or Firm*—Dykema Gossett PLLC

(57) ABSTRACT

The invention relates to an air core filling system for reclining or seating furniture, for example, for a mattress, an armchair, a car seat, a piece of camping furniture or similar, comprising an air core and an integrated air core filling system, reacting to a load, which independently, supplies a dosed amount of air into the air core, in order to maintain the same at a given adjustable pressure in the non-loaded state. Said air core filling system comprises an air pump system (3) with at least two separate chambers (2, 6) and control system (17), whereby the first chamber (2) is directly connected to the air core by a line (1) and a second chamber (6) is connected to the air core by a line (7) through a pressure regulation valve (13) and to the ambient air by a line (9). The air pump system (3) is preferably embodied in the form of a double-chamber bellows, whereby the chambers (2, 6) have a common defining surface (4), on which a return device, for example, a spring (5), acts, in order to almost completely empty the chambers (2, 6) on relief of the air core.

9 Claims, 1 Drawing Sheet

U.S. PATENT DOCUMENTS

| | | | | | |
|---|---|---|---|---|---|
| 2,062,220 | A | * | 11/1936 | Harris | 137/224.5 |
| 2,613,607 | A | * | 10/1952 | Sheen et al. | 417/473 |
| 2,933,098 | A | * | 4/1960 | Lisiak | 137/224 |
| 3,444,922 | A | * | 5/1969 | Dingman | 417/473 |
| 4,274,452 | A | * | 6/1981 | Schmitt | 137/625.3 |
| 4,306,322 | A | | 12/1981 | Young et al. | |
| 4,418,737 | A | * | 12/1983 | Goodell et al. | 152/416 |
| 5,652,985 | A | | 8/1997 | Wilkinson et al. | |
| 6,144,295 | A | * | 11/2000 | Adams et al. | 137/224 |
| 6,772,812 | B1 | * | 8/2004 | Hamilton | 137/224 |

FOREIGN PATENT DOCUMENTS

| | | | | |
|---|---|---|---|---|
| FR | 2087457 | | | 12/1971 |
| JP | 2000051012 | | | 2/2000 |
| WO | WO 2006053351 | A1 | * | 5/2006 |

* cited by examiner

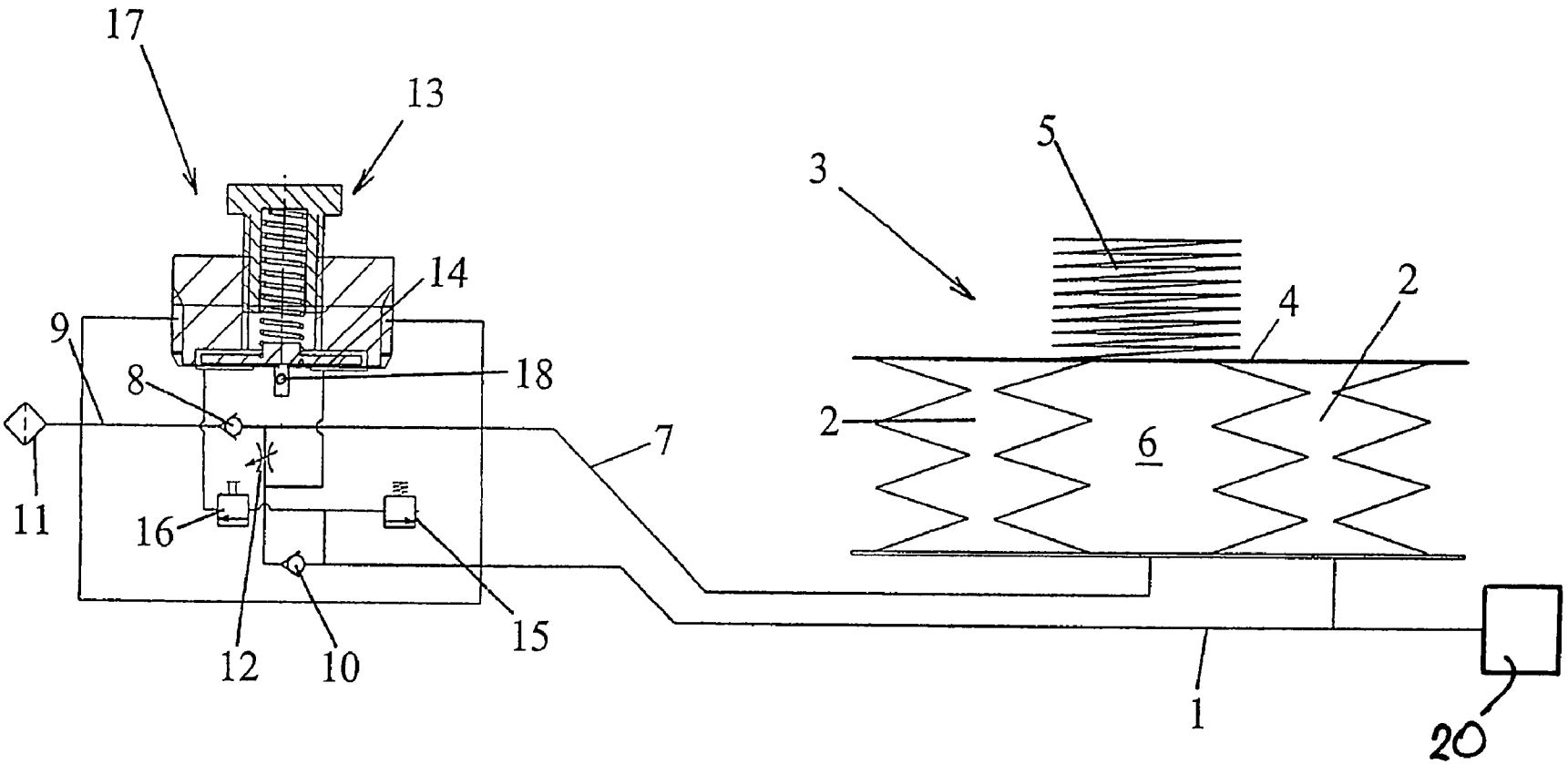
Fig.

AIR CORE FILLING SYSTEM

BACKGROUND OF THE INVENTION

1. Field of the Invention

The present invention relates to an air core filling system for furniture, especially for a mattresses and seating furniture, but also for car seats and camping furniture which have an air-filled core.

2. The Prior Art

Reclining or seating furniture with an air-filled core have long been known. They are regarded as the logical further development of the waterbed, which was originally preferably used in hospitals. As a result of the water filling of the mattress, it was possible to achieve a more even pressure distribution over the entire contact surface in order to prevent the feared bedsores.

Waterbeds come with a number of disadvantages, however. Bodily weak persons have difficulties changing their lying position. This is caused by the fact that in the case of a change of position, it is necessary that the water in the mattress under the body needs to be moved too. Such mattresses are therefore even dangerous for babies. Further disadvantages are the comparatively cumbersome handling and the very high weight. A further problematic aspect is that it has been noticed that water is a very good heat-transfer medium. The filling with water, which normally has room temperature at most, needs to be heated continually to a temperature of approximately 25° C. to 28° C. in order to avoid withdrawing temperature from the body in an unpleasant and especially hazardous manner. Such temperatures are absolutely damaging for persons with venous diseases. Since air is an adverse heat-transfer medium, tempering devices can be omitted in mattresses with an air core without having to give up the known advantages of the waterbeds. All other indicated disadvantages of waterbed can be avoided by using a mattress with an air core. Moreover, there is a better adjustment of the support to the user's body shape because there is no lateral displacement of water as in the waterbed. Instead, the displaced air quantity will lead to an even increase in the air pressure over the entire volume.

The disadvantageous aspect in seating furniture or mattresses with an air core is however that they are not absolutely gas-tight. As a result of gas diffusion, especially in the case of pressure loads during use, there will be a loss of pressure in the air core which requires periodic refilling. Older systems comprise filling systems which are driven manually or by means of an electromotor in order to hold the once chosen degree of hardness over a substantially indefinite period of time.

An air-core filling system is known from U.S. Pat. No. 4,306,322, comprising an integrated hinged pump which is connected directly with the air core via a ball check valve. The pump is flipped out for re-filling the air core and is compressed manually. It may occur relatively easily that the air core is overfilled and becomes too hard, so that air needs to be bled via a further valve. This cumbersome operation was soon replaced by systems in which air can be filled only up to a preset pressure by means of a control valve.

Automatic refilling systems were also developed in order to also enable a continuous maintenance of the desired pressure in the air core. EP 0 620 716 B1 describes an upper mattress with an integrated air system for example in which a circumferential foamed-material frame is present about an air core in which an air reservoir and supply system is integrated. It consists of an air pump, an air reservoir and a pressure regulating valve. When the foamed-material frame is loaded when the user lays down on the mattress, a pressure is exerted on the pump body integrated in the foamed-material frame which conveys the air from said pump bodies to an air reservoir. The air coming from the pump bodies is compressed and stored there. A one-way valve is installed in the connecting line between the pump bodies and the reservoir. Once the mattress is relieved, the pressure from the pressure reservoir balances the pressure in the air core of the mattress up to a value again which is set on the pressure regulating valve. Once the boundary zone is relieved, the pump bodies suck in ambient air through a further valve by returning to their initial position.

This system has a number of disadvantages however. The air from the pump bodies will only be pressed into the reservoir when the pressure on the boundary zone by sitting on the same is sufficiently high, which means in other words when the user sits fully on the boundary zone. Sitting down usually occurs in such a way that the boundary zone is loaded only by the leg but not by the buttocks. The consequence is insufficient compression of the pump bodies.

A further disadvantage is that the reservoir always needs to be under pressure in order to keep the air core of the mattress at the set value. If there is a loss of pressure in the reservoir for any reason, e.g. by introduction of dust into the one-way valve to the reservoir, maintaining the set pressure value will no longer be possible. On the other hand, the built-up pressure of the compressed air can only be reduced via the air core. This leads to the consequence that a pressure of 100 mbar and more can build up in the reservoir under intensive use, as a result of which the connections and valves are subjected to a high load. A further disadvantageous aspect are the considerably long distances from the air entrance to the reservoir and further to the pressure regulating valve, thus leading to large surface areas for gas diffusion. The likelihood of leakages also rises as a result of the numerous connection points. A further disadvantageous aspect is that an intended pressure reduction in the air core is only possible by diffusion loss, which is why it takes a long time until the pressure in the air core has settled to a lower level.

The present invention is therefore based on the object of avoiding these disadvantages in such a way that a pump and control system is created which works without a reservoir and in the entire air core filling system has the same pressure as in the air core when not loaded. The air supply system in accordance with the invention further has a substantially smaller overall size with considerably reduced connecting lines and also has a number of connecting points which is lower in comparison with the system according to EP 0 620 716 B1 in order to thus reduce any hazards by unintended pressure loss.

The invention will be explained in greater detail by reference to the attached drawing.

BRIEF DESCRIPTION OF THE DRAWING

The drawing shows a schematic view of an air core filling system according to a preferred embodiment of the present invention.

DETAIL DESCRIPTION OF THE PREFERRED EMBODIMENT

The drawing shows the principal arrangement of the invention. The entire apparatus has an overall size with the enclosing housing (not shown) which allows installing the housing in the region of the head or foot end of a mattress. The relevant core of the invention is the pump system which is shown here by way of example as a double-chamber bellows 3 and the control system 17 in operative connection with the pump system. It is understood however that the same invention is also enabled by alternative technical arrangements in which the displaced air from the air core and a chamber receiving the outside air that is sucked in are in direct operative connection and are discharged simultaneously and virtually completely via the return device. The present invention shall also include such technical configurations.

Once the user loads the air core 20, the air is pressed from the air core via the connection line 1 into the first chamber 2 of the double-chamber bellows 3, whereupon the bellows 3 will expand and press with its outside surface 4 against a return spring 5. As a result of the extension of the circumferential chamber 2, the volume of the centrally arranged second chamber 6 is increased, thus resulting in a negative pressure that leads to an intake of ambient air via the line 7 of control system 17. The line 7 is connected via a check valve 8 with the connecting line 9 to the outside air and via a further check valve 10 with line 1. An air filter 11 is situated in the connecting line 9 which reliably prevents the introduction of even the smallest dust particles which might impair the proper function of the check valves.

Once the user relieves the air core 20, the pressure in the air core decreases suddenly and simultaneously also in chamber 2, as a result of which the return spring 5 is able to compress the bellows 3 virtually completely by pressure on its outside surface 4. Return spring 5 has a pressure force which lies approximately 1 mbar to 5 mbar, preferably approximately 2 mbar to 4 mbar, over the normal pressure of the air core. In this process, both the air from the first chamber 2 is pushed back to the air core as well as the air from the second chamber 6 which is pressed via the return valve 10 to the line 1, as a result of which the air loss in the air core can be compensated again after each relief of the air core filling system. Upstream of the check valve 10 there is a flow throttle 12 in order to enable a slow pressure build-up in the air core up to such value which is predetermined by the pressure regulating valve 13. Any air going beyond this escapes in the pressure regulation valve 13 via the air outlet opening 18. This construction ensures that the preset normal pressure of the air core prevails in the entire system.

The pressure regulation valve 13 is arranged as a conventional membrane valve, with the pressure membrane 14 having the largest possible surface area because the precision of the pressure setting is in direct connection with the membrane surface. It was determined in trials that the desired precision leads to satisfactory results at membrane diameters of approximately 15 mm to 70 mm, preferably 30 mm to 50 mm.

If there is any undesirable excess pressure in the system, e.g. by strong heating of the air core, a pressure-relief valve 15 connected with line 1 will open immediately, which valve can be set to a limit pressure of approximately 60 mbar or 70 mbar. This prevents damage caused by excess pressures.

It may also occur however that the originally chosen normal pressure of the air core was chosen too high. As a result of the regulator valve 16 to be actuated manually, the normal pressure of the preferably unloaded air core can be reduced to any desired lower value.

The valves 8, 10, 15 and 16 are preferably arranged as membrane valves whose membrane surface diameter lies in the range of 0.5 cm to 2 cm, preferably close to approximately 1 cm, with the membrane thickness having a strength of approximately 0.2 mm to 0.4 mm, preferably approximately 0.25 mm.

The special advantages of the air core filling system in accordance with the invention are that the automatic air resupply is independent of the respective loading point of the air core because any load will lead to an intake of fresh air, which especially in the case of air cores will lead to a considerable improvement in the reliability as compared with known apparatuses.

A further advantage is the considerably reduced design and the thus enabled, very short connection lines. It is further advantageous that no reservoir with pre-compressed air for refilling the air core is necessary. The likelihood of damaging components and their connection points by the potential build-up of excessive pressure in the air reservoir is reliably avoided because the respective air reservoir which is used for refilling the air core with fresh air has atmospheric pressure at most.

It has proven to be especially advantageous to arrange the air pump system 3 as a double-chamber bellows because in contrast to a pump cylinder the starting friction is reduced to zero at the beginning of the pressure build-up.

The invention claimed is:

1. An air core filling system for reclining or seating furniture, comprising an air core and an integrated air core filling apparatus reacting to a load, said air core filling apparatus supplying a dosed amount of air into the air core in order to maintain said air core at a given adjustable pressure value, comprising an air pump system with at least first and second separate chambers and a control system, said first chamber being directly connected to the air core by a first line and said second chamber being connected to the air core by a second line through a pressure regulation valve and to the ambient air by a third line, and wherein said first and second chambers form a double-chamber bellows, with the first and second chambers having a common delimiting surface on which a return device acts in order to virtually completely discharge the chambers when the air core is relieved.

2. An air core filling system according to claim 1, wherein the first chamber is arranged as a circumferential chamber about the centrally arranged second chamber.

3. An air core filling system according to claim 1, wherein the first and second lines are connected to each other via a check valve.

4. An air core filling system according to claim 1, wherein the second line is connected with the third line via a check valve, which second line is connected with the ambient air and comprises an integrated air filter.

5. An air core filling system according to claim 1, wherein the first line is connected with a pressure relief valve.

6. An air core filling system according to claim 1, wherein the first line includes a regulator valve.

7. An air core filling system according to claim 1, wherein the first line includes a flow throttle.

8. An air core filling system according to claim 1, wherein the pressure regulation valve is a membrane valve, with a pressure membrane having a diameter of 15 mm to 70 mm.

9. An air core filling system according to claim 1, including membrane valves whose membrane surface diameters are in the range of approximately 0.5 cm to 2 cm, with membrane thicknesses of approximately 0.2 mm to 0.4 mm.

* * * * *